United States Patent [19]

Kerr et al.

[11] Patent Number: 4,463,517

[45] Date of Patent: Aug. 7, 1984

[54] NOISEMAKER DEVICE

[75] Inventors: Douglas S. Kerr; Gerald A. Lowe, both of Ashland, Ohio

[73] Assignee: The National Latex Products Company, Ashland, Ohio

[21] Appl. No.: 450,925

[22] Filed: Dec. 20, 1982

[51] Int. Cl.[3] ..... G10D 13/08

[52] U.S. Cl. ..... 446/421; 84/402

[58] Field of Search ..... 46/191; 84/402, 408; 273/67 R

[56] References Cited

U.S. PATENT DOCUMENTS

| | | | |
|---|---|---|---|
| 620,904 | 3/1899 | Gardam | 46/191 |
| 3,059,375 | 10/1962 | Tischer | 46/191 |
| 3,157,000 | 11/1964 | Stavig | 46/191 |
| 3,783,733 | 1/1974 | Zirimis | 46/191 |
| 4,075,922 | 2/1978 | Smith | 46/191 |

FOREIGN PATENT DOCUMENTS

| | | | |
|---|---|---|---|
| 3801 | 4/1901 | Fed. Rep. of Germany | 84/402 |

*Primary Examiner*—Gene Mancene
*Assistant Examiner*—David L. Tarnoff
*Attorney, Agent, or Firm*—Baldwin, Egan, Walling & Fetzer

[57] ABSTRACT

A noisemaker formed of molded plastic material having a central body portion with a projection extending from one end thereof and preferably a pair of paddle portions each having a projection extending from an end thereof, with the paddle portions being disposed on opposite sides of the body portion, with the paddle portions including flexible hinge sections adapted for providing for pivotal movement of the paddle portions relative to the body portion, and a separate handle member having a recess receiving therein the projections on the body and paddle portions to hold such portions in generally adjacent relation, with means for locking the handle member to the body and the paddle portions. The paddle portions are adapted to pivot into and out of impacting relation to the body portion upon shaking of the noisemaker by the handle member, thus creating a hand-produced rhythmic-like noise.

14 Claims, 10 Drawing Figures

NOISEMAKER DEVICE

This invention relates in general to noisemaking devices for creating a rhythmic-like noise upon shaking of the device, and more particularly relates to a noisemaker device formed of molded plastic material which can be mass produced in an economical manner, and which will effectively produce a rhythmic-like noise when shaken by the user.

BACKGROUND OF THE INVENTION

Noisemakers of the pivotal paddle type are generally known in the prior art. U.S. Pat. No. 3,157,000 dated Nov. 17, 1964 to Arthur Stavig discloses a noisemaking paddle adapted to be actuated by shaking and which is comprised of a juxtaposed pair of elongated paddles secured at one end together as by staples, with a fulcrum member being disposed between the paddles for facilitating impacting relation between the paddle members.

U.S. Pat. No. 3,019,443 dated Feb. 6, 1962 to Carlos Gomez discloses a wooden musical toy comprised of pivotal paddle members which are adapted to impact against a central body portion having an integral handle section, with the paddle portions being pivoted to the body portion by attached hinges, for creating a clacking-like noise.

It is also known in the art to produce a molded plastic clacker formed of a central body portion and unitary handle section, and with pivotal paddle portions hinged to the central body portion, as shown in the enclosed photostat of such a plastic noisemaker. In such prior art plastic paddle, the handle for shaking the noisemaker is formed integrally with the remainder of the central body portion as aforementioned, while the paddle portions are separately formed, requiring a somewhat complex arrangement for forming the various paddle portions and attaching the same into a finished paddle assembly.

SUMMARY OF THE INVENTION

The present invention provides a novel noisemaker formed of molded plastic material, and which can be expeditiously molded utilizing mass production procedures, and comprising a body portion and at least one paddle portion, with a removable or separate handle member adapted for being assembled with the body and paddle portions to maintain the latter in generally adjacent relationship, and with the paddle portion including a flexible plastic hinge for providing for pivotal movement of the paddle portion relative to the body portion upon shaking of the noisemaker by the handle, to create a rhythmic-like noise.

Accordingly an object of the invention is to provide a novel noisemaker formed of molded plastic material and adapted for mass production.

Another object of the invention is to provide a novel noisemaker formed of plastic material which is effective in producing a rhythmic-like noise upon shaking of the noisemaker, and which can be economically produced.

A still further object of the invention is to provide a noisemaker of the aforementioned type which includes a body portion having a projection on one end thereof and a paddle portion having a projection on one end thereof, and a separate handle member having a recess receiving the projections therein to hold the paddle and body portions in generally adjacent relationship, and wherein the paddle portion includes a flexible plastic hinge providing for pivotal movement of the paddle portion relative to the body portion upon shaking of the noisemaker by the handle member, so as to create a rhythmic-like clacking noise.

A still further object of the invention is to provide a noisemaker of the aforementioned type wherein the assembly comprises a pair of paddle portions, one being disposed on each side of the body portion, and having a web connecting the distal ends of the projections on the paddle portions, so that the paddle portions are assembled as a unit with the body portion, with the web being received in the recess in the handle, additionally ensuring the maintenance of the assembly of the body and the paddle portions during shaking of the noisemaker.

Other objects and advantages of the invention will be apparent from the following description taken in conjunction with the accompanying drawings wherein:

DESCRIPTION OF PREFERRED EMBODIMENT

Figure 1:
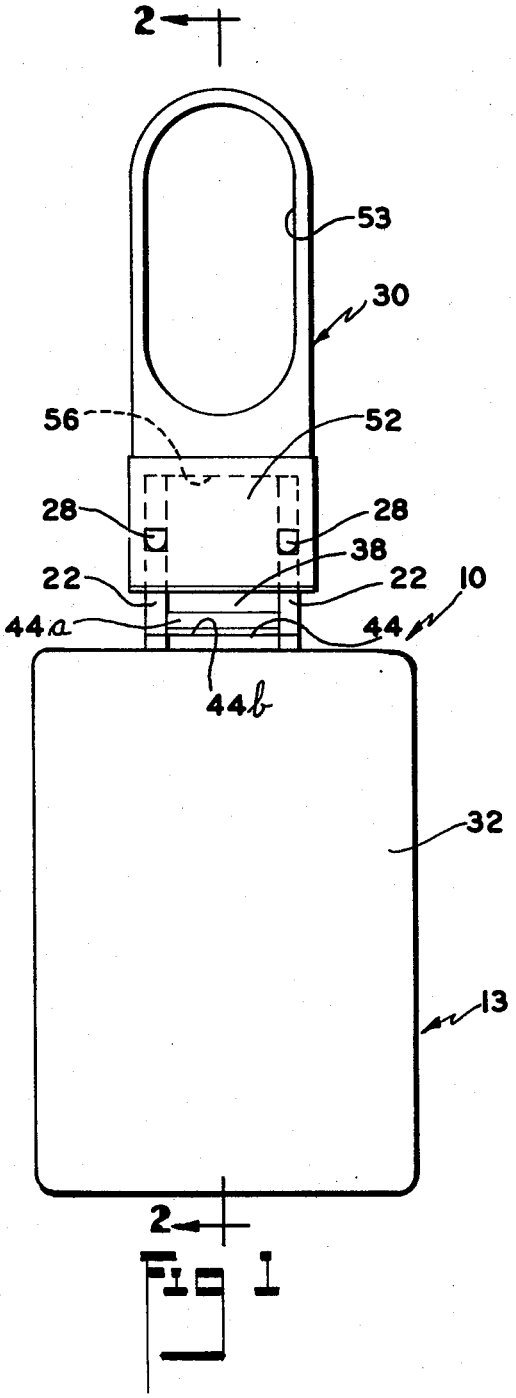
FIG. 1 is a front elevational view of the assembled noisemaker of the invention.
Figure 2:
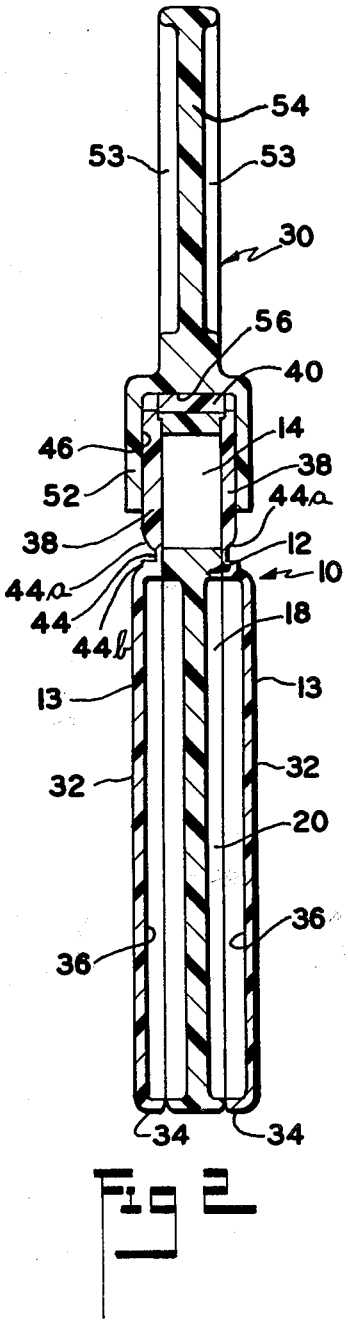
FIG. 2 is a sectional view generally taken along the plane of line 2—2 of FIG. 1 looking in the direction of the arrows.
Figure 10:
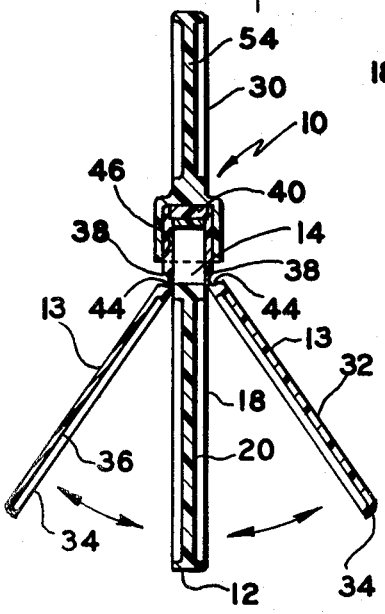
FIG. 10 is a reduced size sectional view, generally similar to that of FIG. 2, but showing the paddle portions swung outwardly away from the body portion of the noisemaker at their plastic hinges thereof, due for instance to shaking of the noisemaker by the handle.

Referring now again to the drawings, there is illustrated in FIGS. 1, 2 and 10 of the application, an assembled noisemaker made in accordance with the invention, and designated generally by the reference number 10. The noisemaker comprises a central body portion 12 which has a projection 14 (FIG. 8) extending from one end thereof. A paddle portion 13 is disposed adjacent to, and in the embodiment illustrated on both sides of, the body portion 12.

Body portion 12 in the embodiment illustrated, comprises a central web 16 which has a raised border on both sides thereof as at 18, defining a percussion cup or recess 20, for a purpose to be hereinafter set forth.

Figure 8:
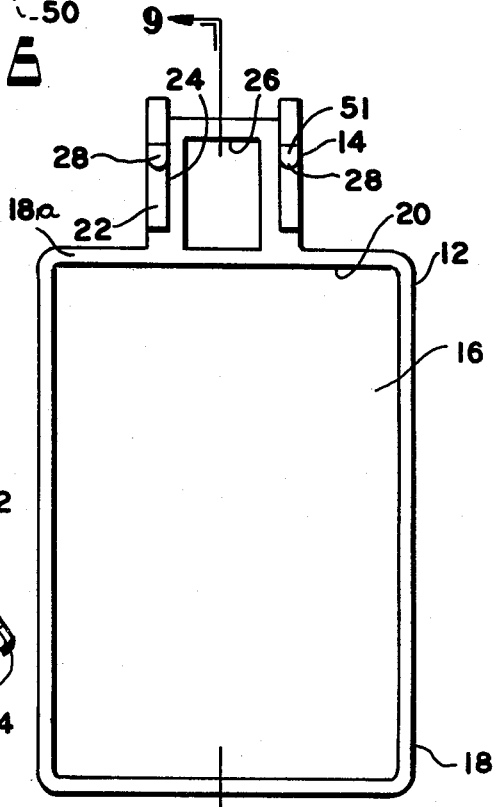
FIG. 8 is an elevational view of the body portion of the noisemaker illustrated in FIGS. 1 and 2.
Figure 9:
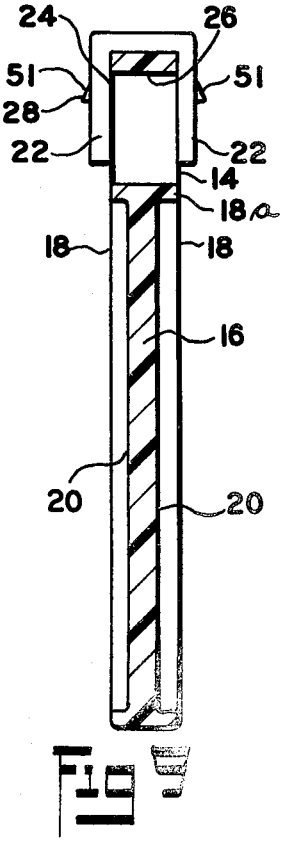
FIG. 9 is a sectional view taken generally along the plane of line 9—9 of FIG. 8, looking in the direction of the arrows.

The projection section 14 of the body portion comprises spaced peripheral shoulder means 22 which commence slightly above the upper border rim 18*a* and extend preferably for the full height of the projection 14 on both sides thereof, as can be best seen in FIGS. 8 and 9. The spaced shoulders 22 define a slot 24 on the body portion projection, for a purpose to be hereinafter described. In the embodiment illustrated, the projection 14 is apertured as at 26, which reduces the weight and the amount of material necessary to form the projection of body portion 12. Each shoulder 22 includes a laterally projecting lug 28 thereon which is preferably integrally molded with the respective shoulder, and which is adapted for locking the separate handle member 30 to the body portion 12 and the adjacent paddle portion 13, as will be hereinafter described in greater detail.

Each of the paddle portions 13 preferably comprises a web 32 and a raised peripheral rim 34 defining a respective percussion recess 36, facing the respective side of the body portion 12 of the assembled noisemaker (FIGS. 2 and 10). Extending from the upper end of each of the paddle portions is a projection section 38 which in the assembled condition of the noisemaker, is adapted to be disposed in generally juxtaposed condition with the projection 14 on the body portion 12 of the noisemaker assembly. In this connection, projection 38 on each of the paddle portions is adapted to be received in the complementary sized, aforementioned slot 24 defined by the laterally spaced shoulder portions 22 on the projection section 14 of the body portion of the noisemaker. Projections 38 on the paddle portions are adapted to be received in generally slip-fit, readily insertable relationship in the respective slot 24, so that assembly of the body portion and the paddle portions can be readily accomplished.

Figure 4:
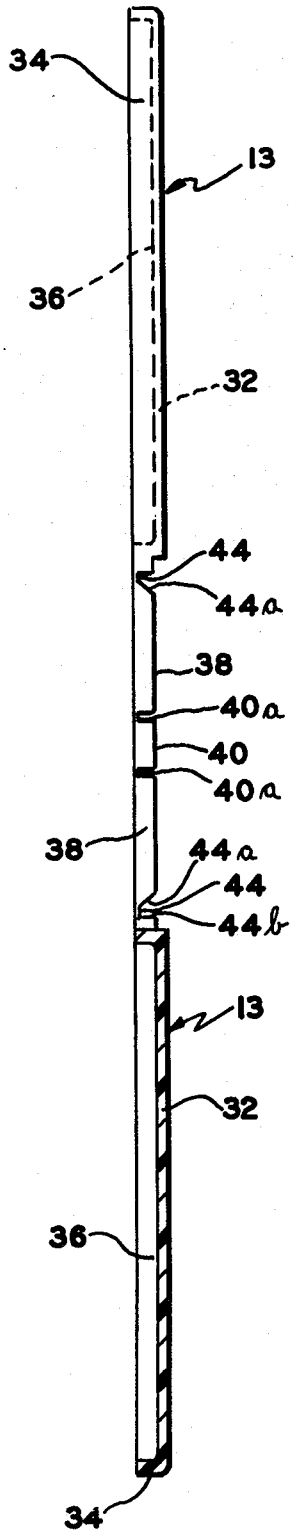
FIG. 4 is a partial sectional view taken generally along the plane of line 4—4 of FIG. 3 looking in the direction of the arrows.
Figure 3:
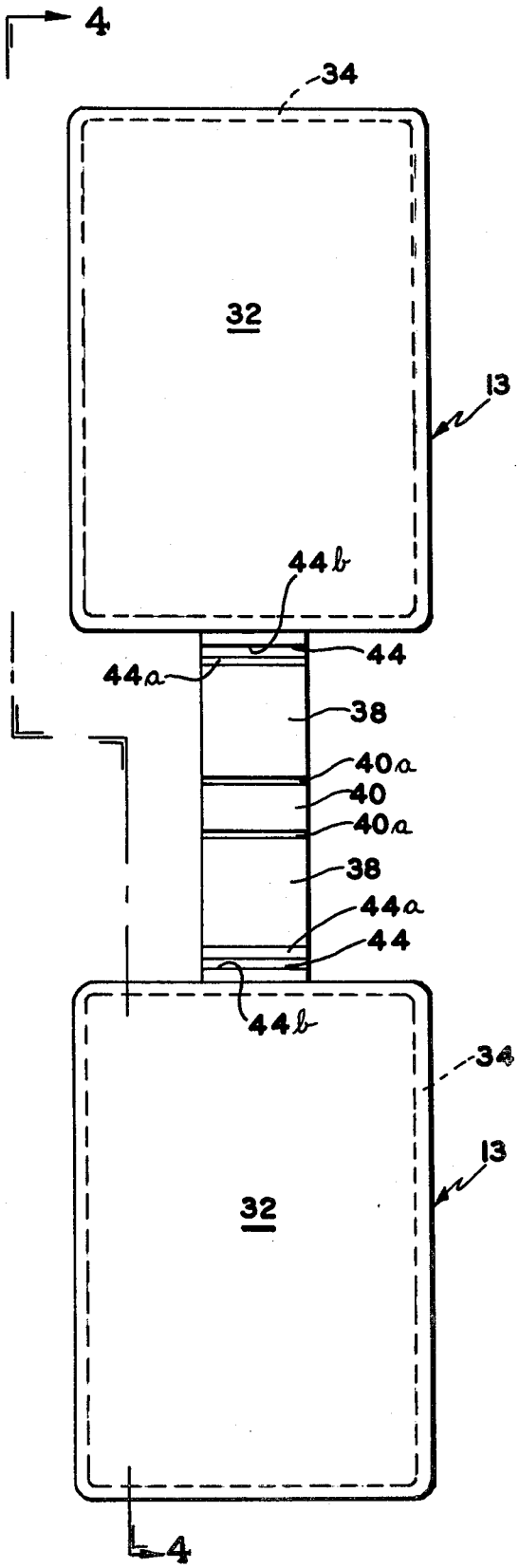
FIG. 3 is a plan view of a pair of paddle portions of the noisemaker, connected by the web, and molded as a unit.

In the preferred embodiment, the pair of paddle portions 13 are connected at the projections 38 thereof, by means of a web section 40 of plastic (FIGS. 3 and 4) thus providing for molding of the paddle portions of the noisemaker as a one-piece unit, with such web 40 including transverse slots 40*a*, for facilitating the bending of the web and the positioning of the paddle portions 13 into generally parallel extending relation for assembly on either side of the body portion of the noisemaker.

Each of the projections 38 on the respective paddle portion includes a flexible plastic hinge 44 which is molded as a unit with the paddle portions, and which is adapted to provide for ready pivotal movement of the respective paddle portion away from and toward the centrally located body portion of the noisemaker, and as generally illustrated for instance in FIG. 10, thus providing for impacting of the pivotal or swingable paddle portions with the central body portion when the noisemaker is shaken by the handle 30, thus producing a hand produced, rhythmic-like clacking noise. Hinge 44 is preferably defined by sloping surface 44*a* and generally perpendicular surface 44*b*.

Figure 5:
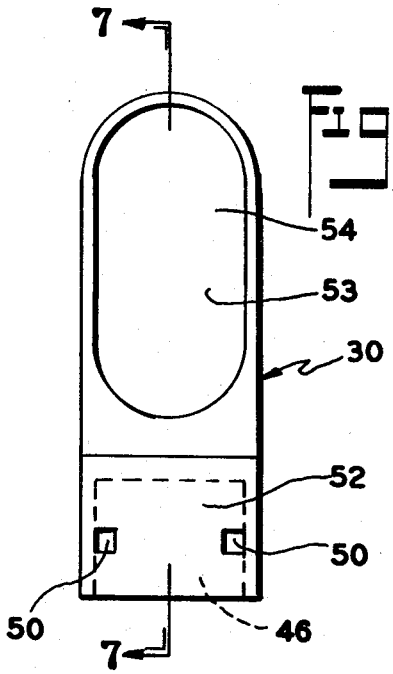
FIG. 5 is an elevational view of the separate handle member of the noisemaker.
Figure 7:
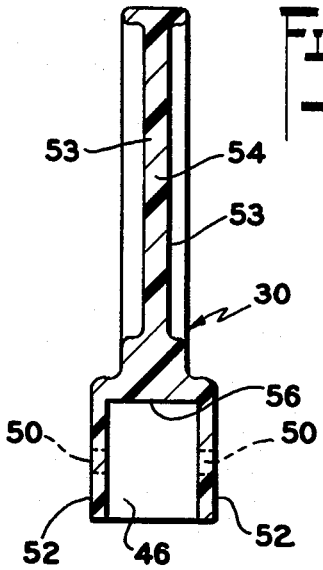
FIG. 7 is a sectional view taken generally along the plane of line 7—7 of FIG. 5 looking in the direction of the arrows.
Figure 6:
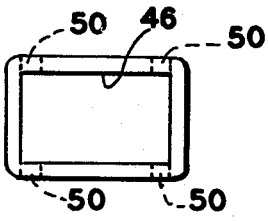
FIG. 6 is an end elevational view taken from the bottom of FIG. 5.

The aforementioned separate handle member 30 includes a recess 46 (FIGS. 5, 6 and 7) formed therein, and which is adapted to receive in the recess the generally juxtaposed projection sections of the body and paddle portions of the noisemaker, as illustrated for instance in FIG. 2, for maintaining the paddle and body portions in assembled relationship with respect to one another.

The handle preferably includes spaced openings 50 formed in opposing walls thereof, through which are adapted to project the aforementioned lugs 28, upon assembly of the handle onto the nested projections of the adjacent paddle and body portions. When the lugs 28 extend into the openings 50, the handle is locked to the body and paddle portions so that when the noisemaker is shaken by the handle member, to cause impacting of the paddle portions with the centrally located body portion as the paddle portions swing or pivot about their hinge sections, a rhythmic-like clacking noise is provided. Lugs 28 preferably have sloping outer cam surfaces 51 (FIG. 9) to facilitate the outward flexure of the apertured walls 52 of the handle during the forcing of the handle over the projections 14, 38 of the body and paddle portions, until the lugs 28 snap into the respective opening 50 in the handle.

The handle as can best be seen in FIGS. 1 and 2, may be molded so as to provide indentations 53 on either side thereof, with the central web 54 of the handle being able to be imprinted or molded with advertising or the like.

As can be seen in FIG. 2, when the projections 14 and 38 on the body and paddle portions are inserted fully within the recess 46 in the handle 30, the web section 40 connecting the projections on the pair of paddle portions is in generally abutting condition with the innermost surface 56 of the handle recess (FIG. 2), while the aforementioned lugs 28 extending through the respective opening 50 in the wall 52 of the handle, prevents the paddle and body portions from separating from the handle during shaking of the noisemaker.

While the noisemaker as illustrated is shown with a pair of paddle portions connected together, it will be understood that it would be possible to make a noisemaker embodying the invention with only one paddle portion thereon. However a pair of paddle portions is preferred, and adds substantially to the noisemaking capability of the article, as well as enhancing the assembly of the noisemaker.

The noisemaker is preferably formed of polypropylene, which gives the article a long service life and especially provides a long service life to the hinge section 44 on the paddle portions, which are subject to considerable stress or strain since they pivot outwardly with respect to the centrally located body portion, and which are subjected to considerable fatigue stress after a period of use.

From the foregoing description and accompanying drawings it will be seen that the invention provides a novel noisemaker formed of plastic material which is adapted for mass production, and which comprises a body portion having a projection on one end thereof and at least one paddle portion having a projection on one end thereof, with the paddle portion including a flexible plastic hinge adapted for providing pivotal movement of the paddle portion relative to the body portion, and wherein there is provided a separate handle member having a recess receiving therein the juxtaposed projections to hold the body and paddle portions in generally adjacent relationship, together with means for locking the handle member to the body and paddle portions, with the paddle portion being adapted to pivot into and out of impacting relation to the body portion upon shaking of the noisemaker by the handle, to create a hand produced rhythmic-like noise.

The terms and expressions which have been used are used as terms of description, and not of limitation, and there is no intention in the use of such terms and expressions of excluding any equivalents of any of the features shown or described, or portions thereof, and it is recognized that various modifications are possible within the scope of the invention claimed.

We claim:

1. A noise maker formed of plastic material comprising a body portion having a projection on one end thereof, at least one paddle portion having a projection on one end thereof, said at least one paddle portion including a flexible plastic hinge adapted for providing for pivotal movement of said at least one paddle portion relative to said body portion and to said projections, a separate handle member having a recessed end receiving therein said projections, to hold said portions in generally adjacent relation, means for locking said handle member to said body portion and said at least one paddle portion, said at least one paddle portion being adapted to pivot into and out of impacting relation to said body portion upon shaking of said noisemaker by said handle member, to create a rythmic-like noise, and wherein said projection on said body portion comprises spaced peripheral laterally projecting shoulders defining therebetween a recessed slot portion in said body portion projection, receiving therein said projection on said at least one paddle portion, said locking means comprising lug means on said shoulders received in complementary openings in said handle member for interlocking the handle member to said body portion and at least one paddle portion.

2. A noisemaker in accordance with claim 1 wherein said at least one paddle portion is formed of polypropylene, giving long service life characteristics to said noisemaker and especially to said hinge.

3. A noisemaker in accordance with claim 2 wherein said hinge has a thickness of approximately 0.03 inch.

4. A noisemaker in accordance with claim 2 wherein there is provided a pair of paddle portions, each one of which is disposed on a respective side of said body portion so that the latter is generally centrally disposed between said paddle portions, said paddle portions being connected at the distal ends of said projections thereon by web means, said web means being disposed in the recess of said recessed end of said handle member, extending transverse of said body portion projection adjacent the distal end thereof, each said paddle portion including a raised border defining a percussion cavity facing the respective side of said body portion, said hinge on each said paddle portion being disposed on said projection thereof and extending transverse of the latter intermediate the anchored and the distal ends thereof, each said hinge being of V-like configuration in elevation and defined by a sloping surface and another surface oriented generally perpendicular to the exterior surface of said paddle portion projection.

5. A noisemaker in accordance with claim 4 wherein said handle member recess is defined in part by a back wall which is adapted for generally abutting engagement with said web in the assembled condition of said handle member with said projections.

6. A noisemaker in accordance with claim 4 wherein said paddle portions and connecting web are molded as a unitary one-piece unit.

7. A noisemaker in accordance with claim 1 wherein there is provided a paddle portion on each side of said body portion, resulting in the latter being centrally disposed between said paddle portions, and web means connecting the distal ends of the projections on said paddle portions, said web means being disposed in said handle recess extending transverse of the distal end of said body portion projection, said web means insuring the maintenance of the assembly of said body and said paddle portions, during said shaking of said noisemaker.

8. A noisemaker in accordance with claim 1 wherein said body portion has a raised peripheral border on the side thereof facing said at least one paddle portion and defining a percussion cup disposed in confronting relation with said at least one paddle portion, and wherein said recessed slot portion on said body portion projection is complementarily sized to said projection on said at least one paddle portion received therein.

9. A noisemaker in accordance with claim 1 wherein said hinge extends transverse of said projection on said at least one paddle portion intermediate the anchored and the distal ends of said paddle portion projection.

10. A noisemaker in accordance with claim 1 wherein said recessed end of said handle member is defined by generally flexible side walls and more rigid end walls, said openings extending through at least one of said side walls from the exterior thereof into communication with the recess in said recessed end of said handle member, said lug means on said shoulders facing said at least one side wall whereby such said at least one side wall is forced outwardly relative to the lug means during movement of said handle member into interlocking holding coaction with said body and paddle portions, whereupon said lug means snap into the respective of said openings in said at least one one side wall of said handle member.

11. A noisemaker in accordance with claim 10 wherein said lug means comprise sloping outer cam surfaces thereon to facilitate said outward flexure of said at least one side wall.

12. A noisemaker in accordance with claim 1 wherein said projection on said body portion comprises an apertured central section, said spaced peripheral shoulders receiving therebetween said projection on said at least one paddle portion in generally abutting relation to said central section, the laterally projecting height of each said shoulder from said central section being substantially the same as the thickness of said at least one paddle portion projection whereby when said handle member is forced onto said projections for receiving said projections in said recessed end of said handle member, said at least one paddle portion projection is snugly held in assembled relation with said body portion projection.

13. A noisemaker in accordance with claim 12 wherein said at least one paddle and body portions are of generally similar exterior size and configuration.

14. A noisemaker in accordance with claim 1 wherein said at least one paddle portion includes a raised border defining a cavity forming a percussion cup on said at least one paddle portion facing said body portion.

* * * * *